United States Patent [19]

Pearson

[11] 3,999,824

[45] Dec. 28, 1976

[54] CABINET SOFFIT ASSEMBLY

[76] Inventor: Ronald D. Pearson, 22015-146th Ave. E., Graham, Wash. 98338

[22] Filed: Dec. 8, 1975

[21] Appl. No.: 638,368

[52] U.S. Cl. ..... 312/297; 312/138 R; 312/204; 312/245

[51] Int. Cl.[2] ..... A47B 97/00

[58] Field of Search ..... 312/297, 279, 278, 245, 312/210, 204, 253, 301, 138

[56] References Cited

UNITED STATES PATENTS

| | | | |
|---|---|---|---|
| 194,703 | 8/1877 | Mayo | 312/245 |
| 287,399 | 10/1883 | Winter | 312/204 |
| 688,819 | 12/1901 | Ballard | 312/245 |
| 842,780 | 1/1907 | Gardner | 312/301 |
| 1,690,404 | 11/1928 | Dieckmann | 312/204 |
| 1,782,819 | 11/1930 | Hansen | 312/138 R |
| 2,632,682 | 3/1953 | Corrigan | 312/210 |
| 3,222,116 | 12/1965 | Levenberg | 312/245 |
| 3,419,933 | 1/1969 | Gossen | 312/138 R |
| 3,601,462 | 8/1971 | Fenwick | 312/138 R |

*Primary Examiner*—Paul R. Gilliam
*Assistant Examiner*—Victor N. Sakran
*Attorney, Agent, or Firm*—Eugene D. Farley

[57] ABSTRACT

A cabinet soffit assembly comprises a soffit base adapted to be fastened to the front margin of a cabinet top, a ceiling trim piece registering therewith, and panel means, preferably sliding door panels, mounted between the soffit base and the ceiling trim piece. Additionally, a plate rail is secured to the soffit base in horizontally offset relation thereto.

2 Claims, 6 Drawing Figures

CABINET SOFFIT ASSEMBLY

BACKGROUND AND SUMMARY OF THE INVENTION

This invention pertains to cabinet assemblies. It pertains particularly to cabinet soffit assemblies for use in enclosing the soffit space present between the tops of wall cabinets and the ceiling.

Conventionally, the soffit space present between the top of a wall cabinet and the ceiling is enclosed by framing the space; covering the framing with wallboard; taping, texturing, painting or wallpapering the wallboard; and applying piece by piece any desired decorative elements.

This procedure obviously is tedious, time consuming, and relatively costly. Also, it does not lend itself economically to the inclusion of highly decorative features such as plate rails and face paneling in various styles and configurations.

It accordingly is the general purpose of the present invention to provide a cabinet soffit assembly which is integrated with the cabinet and may be applied rapidly and easily either at the time of installation of the cabinet, or subsequently as a do-it-yourself project.

It is a further object of the present invention to provide a cabinet soffit assembly which lends itself particularly to the inclusion of sliding doors providing access to the soffit space, thereby converting such space to useful storage space.

It is a further object of the present invention to provide a cabinet soffit assembly which lends itself to the inclusion of plate rails of various styles and dimensions.

Another object of the present invention is the provision of a cabinet soffit assembly which, without expensive redesigning, permits the use of a wide choice of decorative panels vertically enclosing the soffit space.

Still another object of the present invention is the provision of a cabinet soffit assembly the construction of which equalizes any unevenness or out-of-level condition which may exist between the ceiling and the cabinet.

Broadly stated, the cabinet soffit assembly accomplishing the foregoing and other objectives and purposes of this invention comprises a soffit base; first fastening means for fastening the soffit base to the front margin of a cabinet top, longitudinally thereof; a ceiling trim piece; and second fastening means for fastening the ceiling trim piece to the ceiling in substantial registration with the soffit base and spaced vertically therefrom. Panel means, which may comprise sliding door means, are mounted vertically between the soffit base and the ceiling trim piece.

In one important embodiment of the invention, the soffit base extends outwardly from the cabinet in the horizontal plane and includes a plate rail disposed along the top of the cabinet in horizontally offset relation thereto. The plate rail is secured to the soffit base by suitable means, as by means of tongue and groove joining.

The plate rail, as well as the insert paneling, may be of various styles and configurations to suit particular applications without requiring any modifications whatsoever of the basic structure.

DESCRIPTION OF PREFERRED EMBODIMENTS OF THE INVENTION

Figure 1:
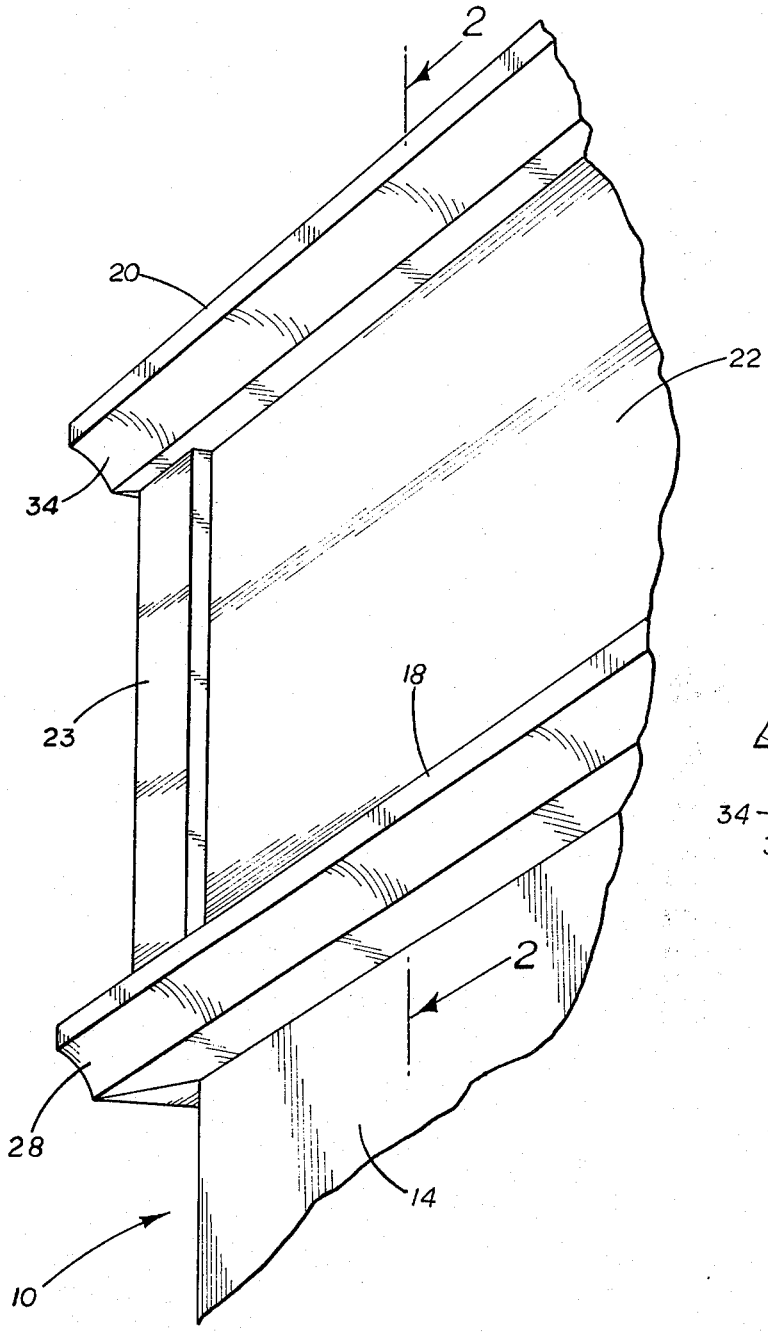
Figure 2:
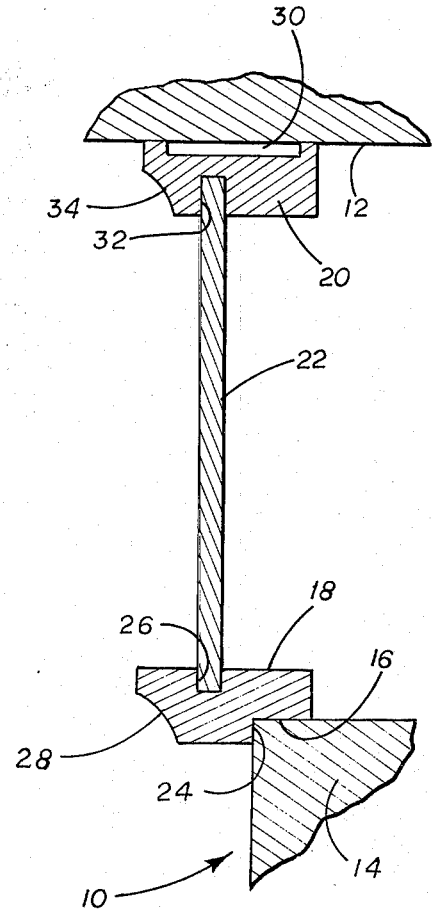
Figure 3:
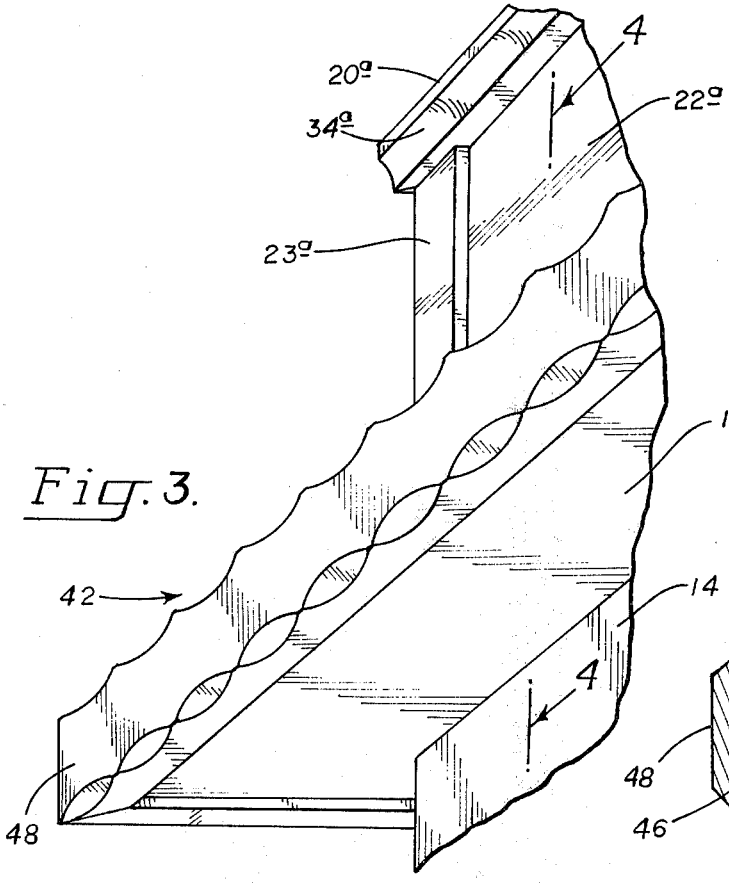
Figure 4:
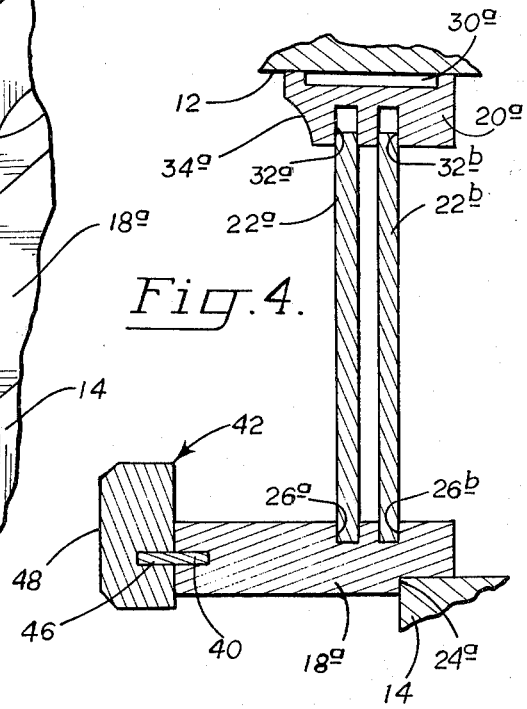
Figure 5:
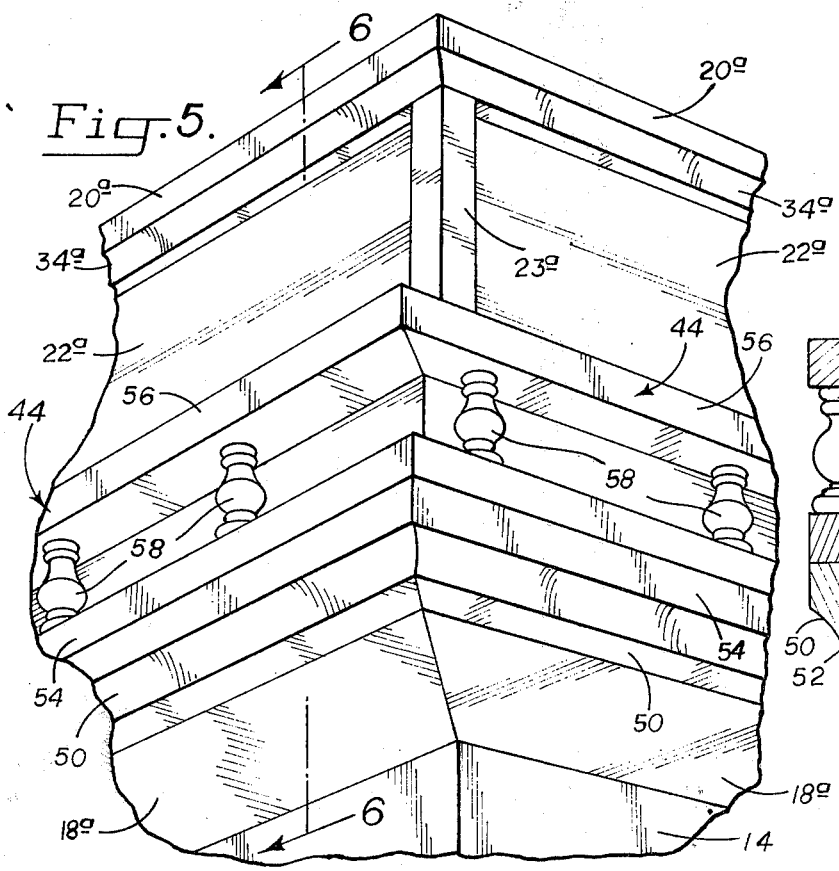
Figure 6:
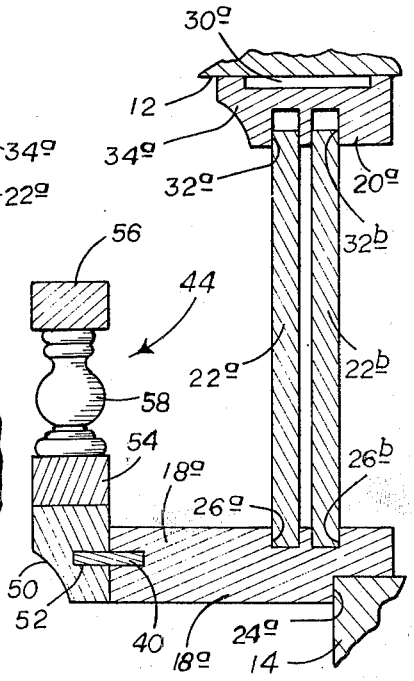

The presently described cabinet soffit assembly is described with particular reference to the drawings, wherein:

FIGS. 1, 3 and 5 are fragmentary, bottom, perspective views of the cabinet soffit assembly of my invention in first, second and third embodiments, respectively; and FIGS. 2, 4 and 6 are transverse sectional views taken along lines 2—2, 4—4 and 6—6 of FIGS. 1, 3 and 5 respectively.

The cabinet soffit assembly of my invention is designed to enclose the soffit space present above cabinets of various styles, configuration and use. It is applicable particularly to enclosing the space between the top of a wall-type kitchen cabinet and the ceiling above.

In FIG. 1 of the drawings, the soffit assembly is illustrated in its application to the enclosure of the soffit space above a cabinet 10 and the room ceiling 12. The cabinet is provided with a top 14 having along its outer margin a projection or corner 16. The hereindescribed soffit assembly is mounted on the top, extends upwardly to the ceiling, and encloses the space between the cabinet top and the ceiling.

To this end there are provided on each side of the cabinet top an assembly of three principal elements: a soffit base 18, a ceiling trim piece 20, and a vertical insert panel 22 supported between the two. A corner piece 23 integrates the insert panels at each corner.

Soffit base 18 has along its inner lower margin a longitudinal groove 24 which receives a corner of projection 16 of the cabinet top, thereby locating the base on the cabinet top. The base further includes along its upper surface a longitudinal groove 26 and a front face 28 which is recessed or contoured in a desired decorative manner.

Ceiling trim piece 20 is formed with a longitudinally extending recess 30 on its inner face and a longitudinally extending groove 32 on its outer face. Its front face 34 is contoured or decorated as desired.

In the application of the assembly, soffit base 18 is secured to cabinet part 16 by nails or other suitable fastening means, with or without the application of glue at the interface. Similarly, the ceiling trim pieces are mounted to the ceiling parallel to and in substantial registration with the soffit base, using suitable fastening means such as nails, with or without an application of glue at the interface.

In the mounted condition of these two elements of the assembly, groove 26 in the soffit base registers with and is parallel to groove 32 in the ceiling trim piece. The two cooperating grooves then receive insert panel 22 which may have a character and design widely varied to achieve various decorative effects. Thus, the panel may comprise prefinished wood to match the cabinets, vinyl covered paneling, simulated brick paneling, translucent plastic paneling, or wallpaper covered-plain paneling.

Also, the single panel may be replaced by double panels mounted in double grooves and providing sliding doors which transform the soffit space into useful storage space. This latter embodiment is illustrated in FIGS. 3 and 4 of the drawings.

In the form of the invention illustrated therein, soffit base **18*a* is provided on its underface with a longitudinal recess 24***a* which receives a corner of cabinet 14 and locates and stabilizes the soffit assembly.

The upper surface of the soffit base is provided with a pair of parallel grooves 26*a* and 26*b*.

Ceiling trim piece 20*a*, has on its upper surface a longitudinal recess 30*a* and on its lower surface a pair of parallel grooves 32*a* and 32*b*. In the mounted condition of the soffit base and ceiling trim piece, the latter two grooves register with grooves 26*a*, 26*b* of the soffit base. Together they form a pair of tracks which receive sliding door panels 22*a*and 22*b*.

The embodiment of the invention illustrated in FIGS. 3 and 4 also provides means for mounting a plate rail of selected configuration.

To this end, the soffit base is dimensioned to extend laterally outwardly in a horizontal plane from the top of the cabinet. Its outer face is provided with joining means such as an outwardly extending spline 40 extending along its length. This provides a means for securing a selected plate rail or plate rail assembly, such as the single plate rail illustrated at 42 of FIGS. 3 and 4, or the plate rail assembly illustrated at 44 of FIGS. 5 and 6.

Plate rail 42 is provided on its back face with a longitudinal groove 46 dimensioned to receive spline 40, thereby making it possible to fit the plate rail to the soffit base in laterally offset relation to the front face of the cabinet.

The outer face 48 of the plate rail may be hand hewn or otherwise configured to achieve desired decorative results.

In the alternative, the more elaborate plate rail assembly 44 of FIGS. 5 and 6, or a plate rail assembly of any other desired structure or configuration, may be substituted for the single plate rail of FIGS. 3 and 4.

The plate rail assembly illustrated in FIGS. 5 and 6 comprises a plate rail base 50 having a groove 52 dimensioned to receive spline 40 of the soffit base in tongue and groove relation. Superimposed upon plate rail base 50 and secured thereto adhesively or by nailing, is a spindle sub-assembly comprising spindle base 54, spindle top piece 56, and a plurality of spindles 58 secured therebetween.

It thus will be apparent that by the provision of a simple cabinet soffit assembly comprising only four principal elements: a soffit base, a ceiling trim piece, insert panels or door panels, and a plate rail, I have provided an assembly which may be mounted easily and quickly as an original installation, or subsequently as an installation on an existing cabinet. The assembly is applicable, furthermore, to a wide variety of cabinet types and sizes. Still further, by varying the form and appearance of the key components of the assembly, particularly the insert panels and the plate rail, I am able to achieve a wide variety of decorative effects.

Having thus described my invention in preferred embodiments, I claim:

1. For use in enclosing the soffit space between a wall cabinet top and the ceiling, a soffit assembly comprising:

a. a soffit base,
b. first fastening means for fastening the soffit base to the front margin of the cabinet top longitudinally thereof,
c. a ceiling trim piece,
d. a second fastening means for fastening the ceiling trim piece to the ceiling in substantial registration with the soffit base and spaced vertically therefrom,
e. sliding door panel means mounted between the soffit base and the ceiling trim piece,
f. the soffit base extending outwardly in the horizontal plane and including:
   1. a plate rail comprising a decorative spindle assembly, and
   2. tongue and groove fastening means fastening the plate rail to the soffit base in horizontally offset relation thereto.

2. For use in closing the soffit space between a cabinet top and the ceiling, a soffit assembly comprising:

a. a soffit base having an inner lower margin portion arranged to engage the front margin of the cabinet top and to extend outwardly therefrom in a horizontal plane,
b. a plate rail secured to the outer face of the soffit base,
c. first fastening means for fastening the inner lower margin portion of the soffit base to the front margin of the cabinet top longitudinally thereof,
d. a ceiling trim piece,
e. a second fastening means for fastening the ceiling trim to the ceiling in substantial registration with the inner portion of the soffit base and spaced vertically therefrom, and
f. panel means mounted vertically between the inner portion of the soffit base and the ceiling trim piece.

* * * * *